US005257830A

United States Patent [19]

Pflueger

[11] Patent Number: 5,257,830

[45] Date of Patent: Nov. 2, 1993

[54] COLLAPSIBLE FREIGHT AND STORAGE CONTAINER

[76] Inventor: Rodney J. Pflueger, 905 Oak St., Yreka, Calif. 96097

[21] Appl. No.: 901,037

[22] Filed: Jun. 19, 1992

[51] Int. Cl.[5] ..... B65D 6/16

[52] U.S. Cl. ..... 220/7; 220/6; 220/1.5

[58] Field of Search ..... 220/6, 9.1, 9.2, 9.3, 220/1.5, 7, 8, 666; 217/13, 15, 45, 47

[56] References Cited

U.S. PATENT DOCUMENTS

| | | | |
|---|---|---|---|
| 1,133,648 | 3/1915 | Leary . | |
| 1,507,977 | 9/1924 | Schaefer | 220/6 |
| 1,609,259 | 11/1926 | Macnider et al. . | |
| 1,755,227 | 4/1930 | Robinson | 220/6 |
| 2,361,743 | 10/1944 | Butler . | |
| 2,720,998 | 10/1955 | Potter | 220/6 |
| 2,741,391 | 4/1956 | Belanger . | |
| 2,780,382 | 2/1957 | Beckner et al. . | |
| 2,952,379 | 9/1960 | Potter | 220/6 |
| 2,998,157 | 8/1961 | Holmes . | |
| 3,195,506 | 7/1965 | Beard . | |
| 3,402,845 | 9/1968 | Erikkson . | |
| 3,410,328 | 11/1968 | Sasai | 220/9.2 |
| 3,481,311 | 12/1969 | Schluttig | 220/6 |
| 3,557,855 | 1/1971 | Weingarten et al. . | |
| 3,612,330 | 10/1971 | Baer | 220/6 |
| 3,784,054 | 1/1974 | Mautz | 220/1.5 |
| 3,799,384 | 3/1974 | Hurkamp | 220/6 |
| 3,865,269 | 2/1975 | Coleman | 220/6 |
| 4,805,794 | 2/1989 | Tsuchiya et al. | 220/8 |
| 5,076,457 | 12/1991 | Marovskis . | |

FOREIGN PATENT DOCUMENTS

| | | | |
|---|---|---|---|
| 119297 | 3/1900 | Fed. Rep. of Germany | 220/9.2 |
| 537401 | 11/1931 | Fed. Rep. of Germany | 220/9.2 |
| 1074787 | 2/1984 | U.S.S.R. | 220/1.5 |
| 19534 | of 1904 | United Kingdom | 220/6 |
| 373461 | 5/1932 | United Kingdom | 220/1.5 |

*Primary Examiner*—Allan N. Shoap
*Assistant Examiner*—S. Castellano
*Attorney, Agent, or Firm*—Bryan Cave

[57] ABSTRACT

A collapsible freight or storage container consisting of two equal sized square or rectangular shaped planes (10,18), joined by the affixed ends of two pivotally mounted pendulum suspended support legs (20,22) in each external corner edge of the upper plane (18), and by the opposite ends of respective support legs (20,22), inserted vertically and assigned to one of two groove tracks (14,16) of the lower plane (10), providing mobility and stability of the blocked shaped frame to which accordion style side walls may be firmly affixed, collapses and opens to a plurality of different storage heights under control of a gear driven system (34,36,40) while keeping the platforms (10,18) in parallel relation to each other.

12 Claims, 5 Drawing Sheets

COLLAPSIBLE FREIGHT AND STORAGE CONTAINER

BACKGROUND

1. Field of the Invention

This invention relates to freight containers and particularly to such containers which may be collapsed for transport and opened for storage of contents.

2. Description of the Prior Art

Ever increasing demand for sea-transport shipping has created an even greater demand for shipping containers. Their rapidly increasing numbers has mandated storage space to be at a premium. Presently these containers are of a rigid construction, variable in size and weights. Standard agreeable sizes currently in use include 8'×8'×20' and 8'×9.6'×45'. Standard shape of overseas shipping containers are predominately of the rectangular block configuration, with doors at one end for loading and unloading freight. Such containers are unloaded from shipping vessels at seaport, dock locations and continue their transport by means of trucking or rail-car until a final destination point is achieved. Exorbitant shipping cost factors arise when empty containers are returned to the point of origin. The reason for cost ineffectiveness is due to the fact that empty or full shipping containers are equal in displacement size and shape.

Frequently in the transportation industry, shipping containers are being transported filled far below their maximum storage capacity, which causes these containers to unnecessarily occupy wasted valuable space on board ships, trains, or planes, by way of example. This unfortunate event occurs mostly when various overseas countries order and receive product in a smaller quantity. Identical volume containers are currently being used aboard transoceanic and rail car systems to retain uniformity and compatibility features within their respective transportation systems.

This procedure compounds the cost ineffectiveness by falling far short of 100% capacity.

Although several forms of folding containers, crates, boxes and the like are commonly in use and well known, such as disclosed in U.S. Pat. Nos. 1,133,648; 1,609,259; 2,361,743; 2,741,391; 2,780,382; 2,998,157; 3,195,506; 3,402,845; 3,557,855, and 5,076,457, their system or design of collapsibility becomes obviously impractical when applied to shipping containers capable of use aboard transoceanic and rail car systems. For example, the container disclosed in U.S. Pat. No. 5,076,457, issued to Marovskis, which works well under its intended application, becomes apparently unapplicable when the container has to be subjected to higher weight factors. This is unsatisfactory for optimum use as an overseas freight container where multiple heavy containers may become stacked upon each other in a ship's hold. Identical limitations occur in the other art referred to above since the prior art relates to containers of a manual nature with respect to the system of collapsibility or disassembly.

The present invention overcomes the disadvantages of the prior art and introduces an action which permits empty returnable shipping containers to be collapsed, and so-called full shipping containers to be adjusted to the desired height needed for a full container without disassembly of the container.

SUMMARY OF THE INVENTION

The present invention contemplates a collapsible shipping or storage container which in an erected position supports two parallel planes (top and bottom) by eight or more pivotally mounted pylons or support legs. These support legs are strategically placed in the upper plane (top) in such a fashion as to allow a controlled partial pendulum action to occur as the support legs move to vary the height of the container. The opposite end of each pivotally mounted support leg is inserted into one of two assigned receptacle grooves or tracks in the lower plane (bottom), thus allowing freedom of controlled travel movement of the pivotally mounted support legs. The present invention further contemplates employing, if desired, an accordion configuration for sidewalls which are affixed firmly to the underside of the upper plane (top) perimeter and upper side of the lower plane (bottom) perimeter, thereby creating collapsible sides for the configuration so as to fully enclose the container, if desired. In such cases where uniformly shaped, smaller sized freight is shipped, the accordion style sides may be omitted. It is for this reason that recessions are provided in both the upper and lower plates or planes. A primary example would be of milk crates having uniform shape and where minimum side protection prevails. Both vertical stacking and the same type of working action for the collapsible container could still be employed with the side walls omitted. With the side walls omitted, the internal recessions would provide stability for freight being firmly held in place by the top and bottom planes.

The collapsibility factor advantage becomes apparent when empty containers are to be stacked interlocked, loaded and returned to the point of origin. Dry storage of shipping containers in their present capacity also create numerous other problems; one major problem being that of an exorbitant amount of valuable land being consumed for such storage. One advantage of the present invention is that it enables a utilization of the maximum amount of wasted shipping space in the transportation and storage industry while providing a collapsible shipping container which is re-usable, cost effective, and is efficient and durable in use. In addition, the collapsible shipping and storage container of the present invention retains a constant width and length throughout the ascending and descending collapsibility process while creating a variable desired height. Furthermore, the collapsible shipping and storage container of the present invention, in any desire position, remains capable of vertical stacking and interlocking, for transporting and storage purposes.

Substantial savings are realized in all phases of transportation when cost efficient innovations are utilized properly in an existing system and, as such, the collapsible shipping and storage container of the present invention possesses the unique ability to be collapsed at an estimated ten to one ratio.

BRIEF DESCRIPTION OF THE DRAWINGS

Preferred embodiments of the present invention will be described in greater detail with reference to the accompanying drawings wherein like elements bear like reference numerals and wherein.

DETAILED DESCRIPTION OF THE PREFERRED EMBODIMENTS

Figure 1:
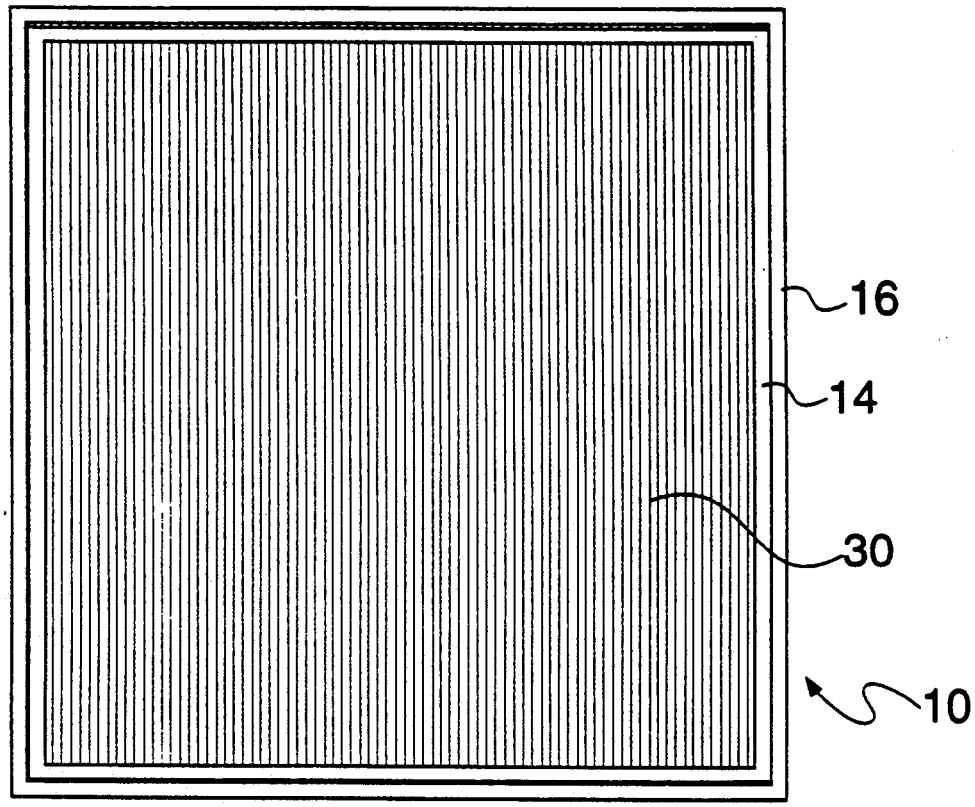
FIG. 1 is a top view of the bottom plane or platform of the present invention.
Figure 2:
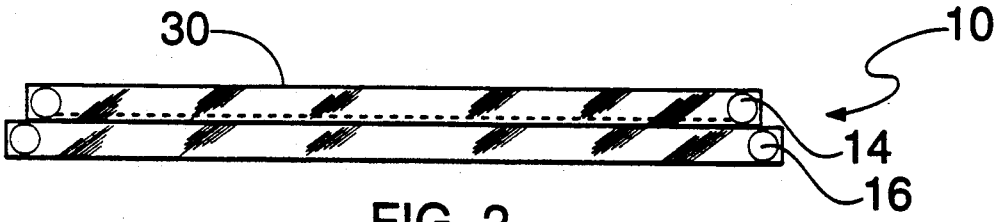
FIG. 2 is a side view of the lower plane or platform of the present invention.

Referring now to the drawings in detail, the unique locomotion of the working action employed in the present invention will become readily evident. The collapsible shipping and storage container of the present invention is preferably comprised of two equal perimeter square or rectangular planes 10 and 18, which are joined together and held apart by four shorter support legs 22 and four longer support legs 20. Each longer support leg 20 is preferably affixed at one end to the upper plane or platform 18 at a designated corner edge. Each shorter support leg 22 is preferably affixed to the upper plane 18 also at a designated corner edge. All support legs are preferably affixed by a conventional bolt or screw and bushing 26 method so as to provide a pivotal mounting to the upper platform 18 at one end. The opposite end of each longer support leg 20 is preferably affixed to the lower plane 10 by inserting insert guide 24 into a lower groove or track 16. The opposite end of each shorter support leg 22 is preferably affixed to the lower plane 10 by inserting insert guide 24 into an upper groove or track 14.

Figure 5:
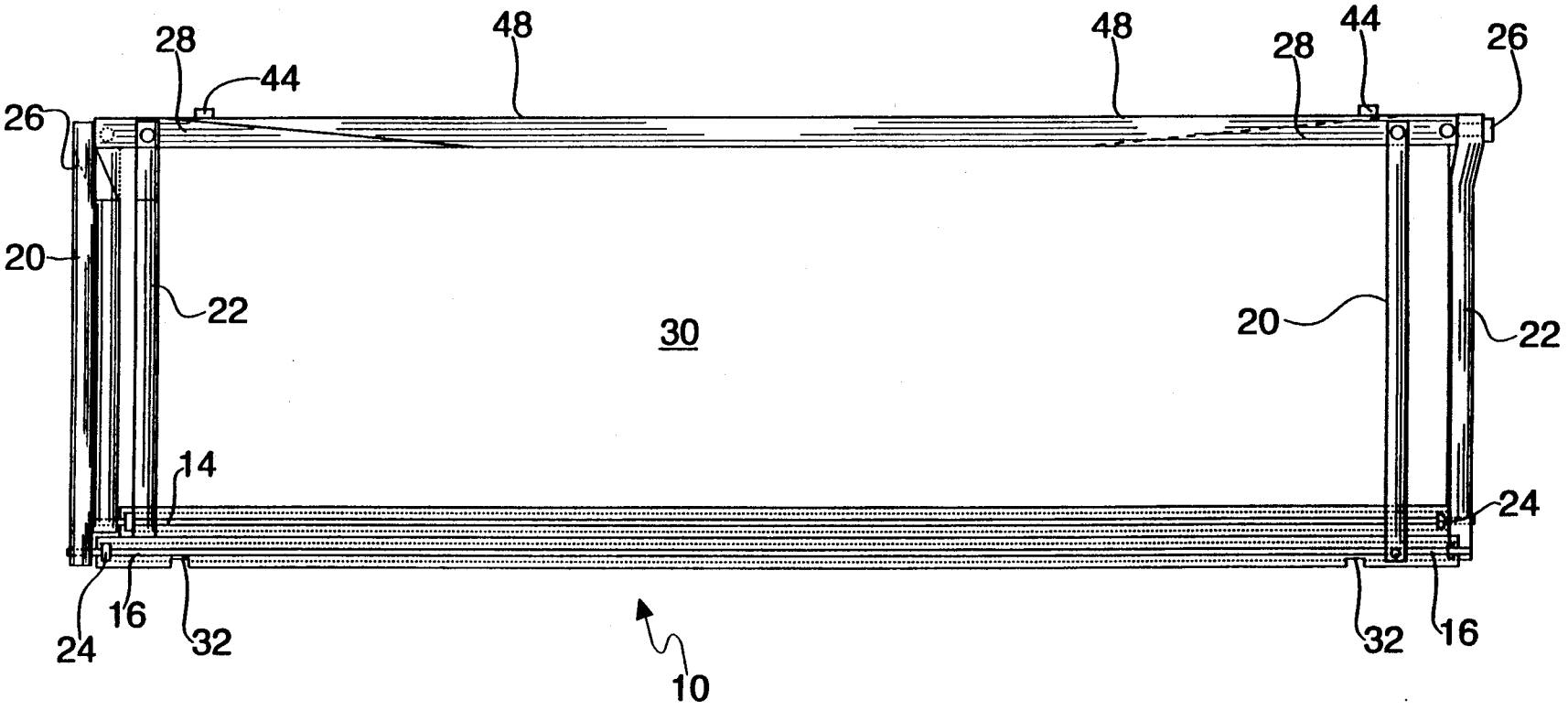
FIG. 5 is a side view of the collapsible shipping and storage container of the present invention in an erect position.

All supporting legs 20 and 22 are preferably affixed in a vertical position so as to form parallel upper 18 and lower 10 planes as shown in FIG. 5. This preferred arrangement constitutes what is termed herein the "working action."

With the "working action" engaged, and the upper plane 18 subjected to a descending motion, the longer support legs 20 and the shorter support legs 22 become responsively engaged in a controlled pendulum motion. The direction of controlled travel by all of the support legs 20,22 preferably remains constant upon ascending and opposite upon descending, while the distance of controlled travel by all of the support legs 20,22 remains constant.

Figure 3:
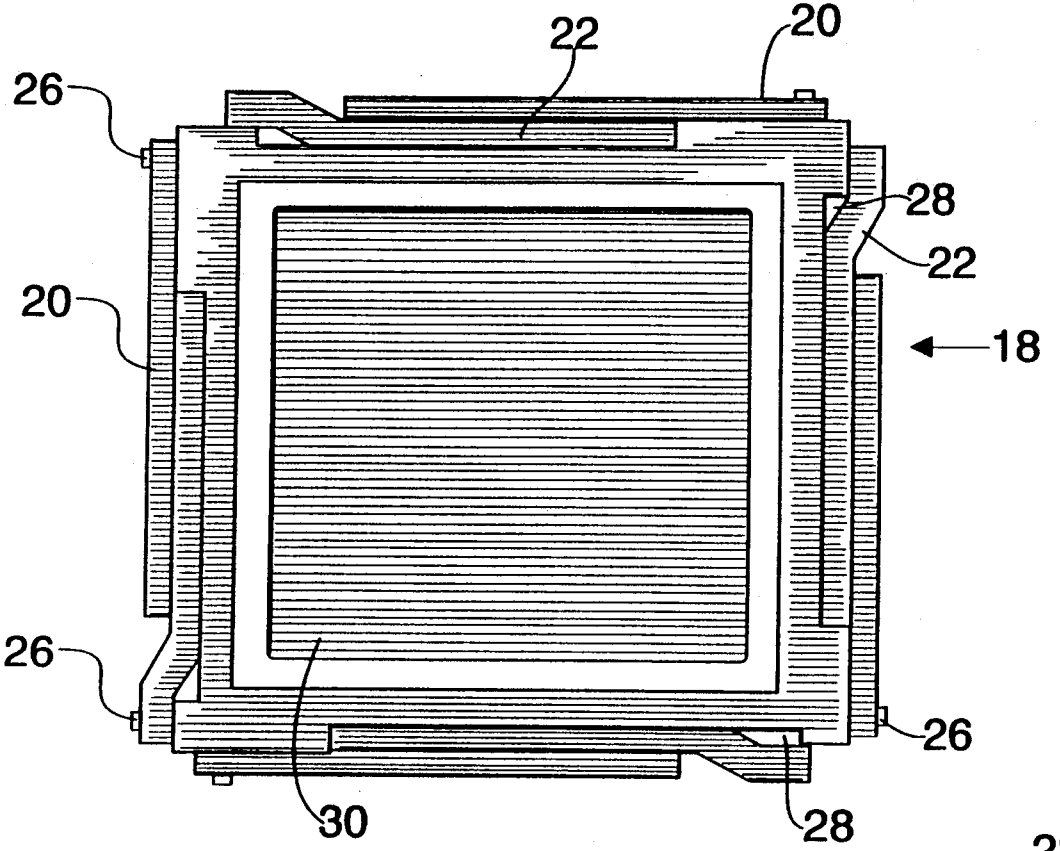
FIG. 3 is an inverted top view of the upper platform or plane of the present invention.
Figure 4:
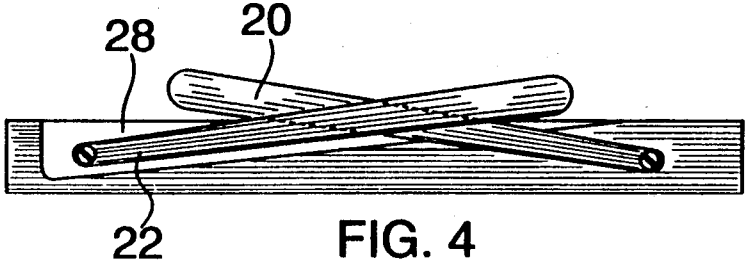
FIG. 4 is an inverted side view of the upper plane of the present invention.

When the descending "working action" is exhausted, and the entire length of controlled travel accomplished, all of the support legs 20,22 become repositioned from perpendicular to near parallel with respect to the upper plane 18 and the lower plane 10. To accommodate compatibility in clearances, a tapered shorter leg recessional area 28 is preferably employed as shown in FIGS. 3–5.

With the collapsible shipping and storage container of the present invention in a totally collapsed position in accordance with the first embodiment, it is now in position for transport via four dual purpose cable attachments or guide pins 44 located on each top corner of the upper plane 18. With the hoist cables removed, the collapsible freight and storage container may be vertically stacked and interlocked by the dual purpose vertical stacking guide pins or cable attachments 44 which insert into interlocking receptacles 32 located on each corner of the underside of the lower plane 10.

Figure 6:
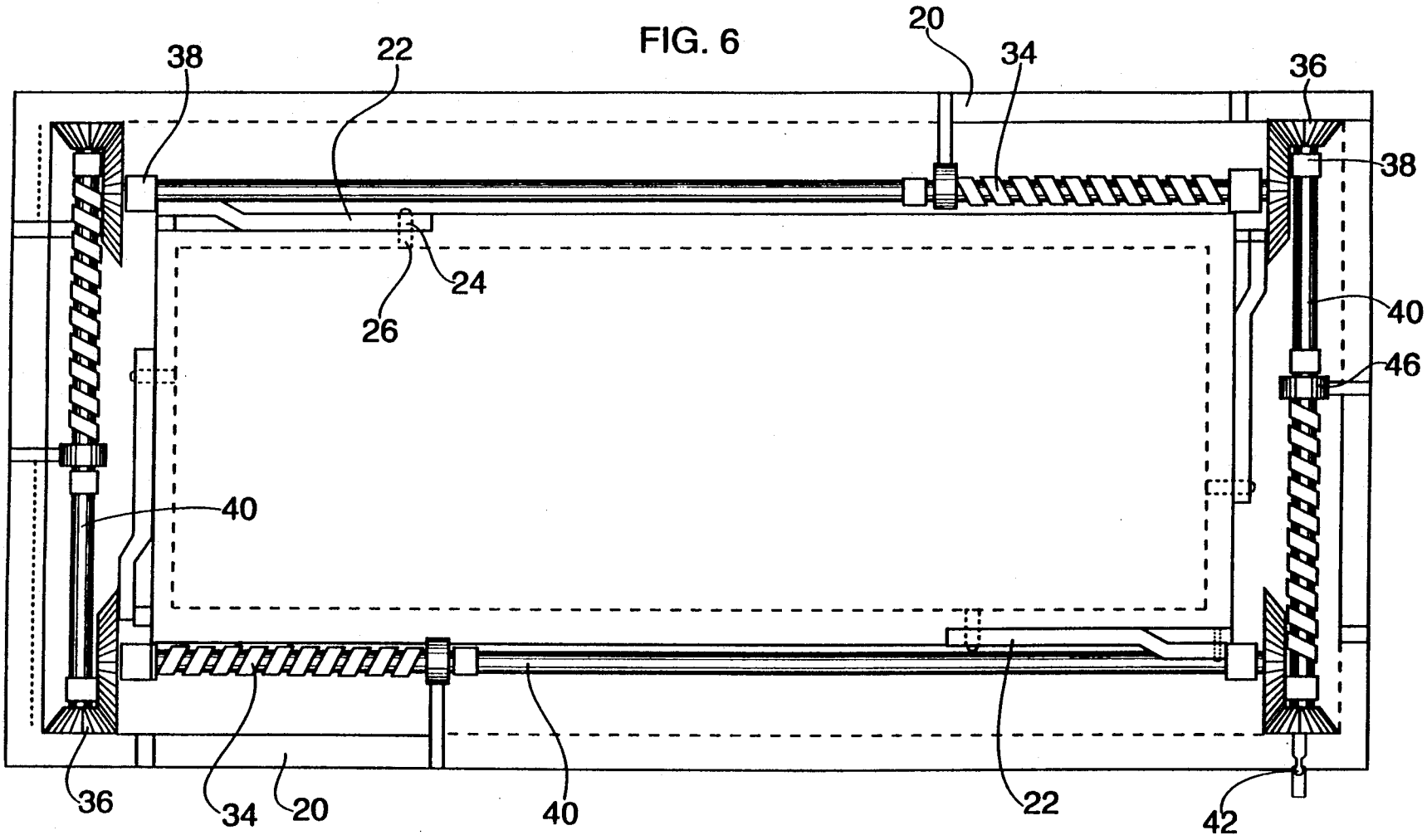
FIG. 6 is a top view of the bottom plane of the present invention illustrating a typical mechanical ascending and descending system.

In order to accommodate the process of ascending and descending of the collapsible shipping and storage container of the present invention, a compatible "lift system" may be employed which cooperates with the "working action" and is incorporated within, such as illustrated in FIG. 6.

As shown and preferred in FIG. 6, the "lift system" is located in a lower groove track 16 of the lower plane 10. It is preferably comprised of a bevel gear system 36 located at each corner of the lower groove track 16. The bevel gears 36 possess an intersecting axis and 90° mitre. A universal joint 42 extends outwardly for attachment to a conventional drive source (not shown). When the drive source is activated after engagement of the universal joint 42, (optional at all corners), a drive shaft 40 running the full length of the lower groove track 16 preferably turns in the desired controlled direction. As shown and preferred, the drive shaft 40 incorporates a worm gear 34 which passes through a compatibly threaded receptacle flange or nut 46.

Once the drive source is inactivated, the drive shaft 40 and worm gears 34 preferably frictionally lock the driven support legs 20. Alternatively, the support legs may be locked at any desired height by any conventionally known means.

The longer support leg 20 is preferably affixed to the receptacle flange 46 or nut in such a fashion as to allow for freedom of movement when ascending or descending. Preferably, the drive shaft 40 is affixed firmly in place to the inside bottom of the lower groove track 16 by means of a pedestal style encased carrier bearing 38.

In a like manner, preferably the entire perimeter of the lower groove track 16 contains the same arrangement and is interconnected through the bevel gear system 36.

Figure 7:
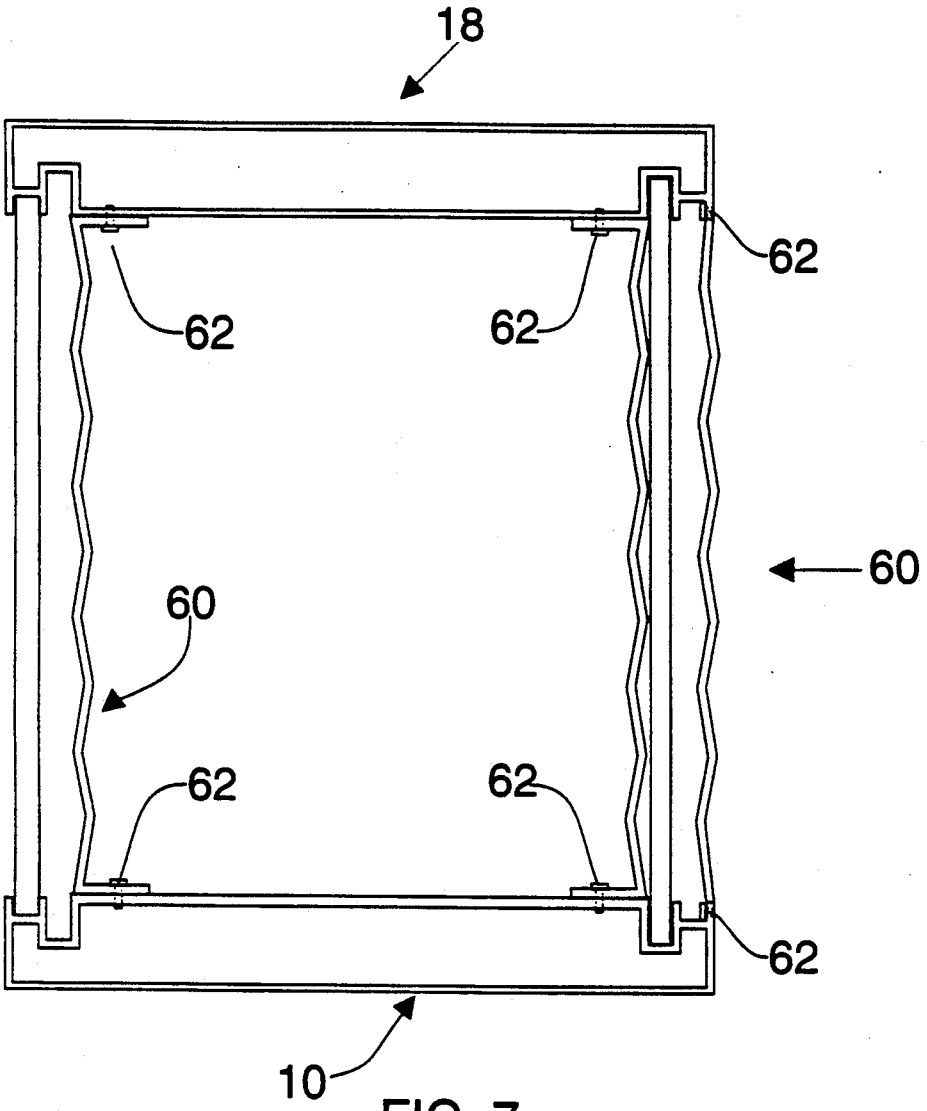
FIG. 7 is a side view of the shipping container of the present invention, including collapsible sidewalls.
Figure 8:
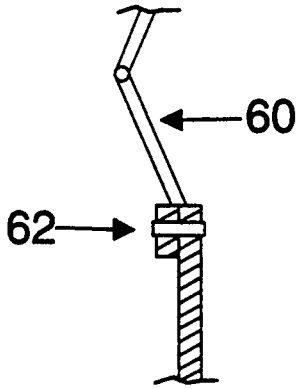
FIG. 8 is an exploded view of the attachment mechanism of the collapsible sidewalls of the present invention.

As shown in FIGS. 7 and 8, the present invention may include conventionally known collapsing sidewalls, 60. Sidewalls 60 may be mounted inside or outside support legs 20 and 22, and are preferably secured to the container by conventional securing means 62 such as a screw and nut.

Preferably, the container top 48 comprises a one piece removable style currently in use or in one or several piece accordion style and affixed in like manner as the aforementioned accordion walls in accommodating fashion.

Summarizing the above discussion, the various components of the present invention which provide the desired working action and which cooperate to provide the collapsible freight and storage container of the present invention are the lower plate or plane 10, the upper groove track 14, the lower groove track 16, the upper plate or plane 18, the longer support legs 20, the shorter support legs 22, the insert guide 24, the bolt or screw and bushing 26, the shorter leg recessional area 28, the internal recession 30, the interlocking receptacle 32, the worm gear 34, the bevel gears-intersecting axis 90° 36, the carrier bearing (encased and pedestal style) 38, the drive shaft 40, the universal joint (optional amount as required) 42, the vertical stacking guide pin/cable attachment for mobility 44, the receptacle flange (nut) 46, and the container top 48.

The principles, preferred embodiments and modes of operation of the present invention have been described in the foregoing specification. However the working action invention to be protected is not to be restricted to the particular embodiments disclosed. Variations, changes and equivalents may be made by others without departing from the spirit and scope of the present invention. Accordingly it is expressly intended that all such variations changes and equivalents which fall within the spirit and scope of the present invention as defined in the claims be embraced thereby.

What is claimed is:

1. A collapsible freight and storage container comprising:

a lower planar platform;

an upper planar platform having a plurality of corner edges and being disposed in said container parallel to and vertically movable toward and away from said lower platform between a collapsed position for facilitating storage and shipment of said container in an empty state, and a plurality of different positions of variable height dependent on an optimum desired storage capacity for said container when it is fully loaded;

a plurality of non-connected pivotally mounted movable support legs each having a single linear member interconnecting said upper and lower platforms, said support legs being pivotally mounted at one end to said upper platform adjacent the corner edges thereof, said lower platform comprising a plurality of peripheral grooves defining a track in said lower platform for the opposite ends of said pivotally mounted support legs, said opposite ends of said pivotally mounted support legs being slidable along said track for enabling aid upper platform to be controllably moved toward and away from said lower platform between said collapsed position where said single linear members are in a substantially horizontal orientation and said plurality of different positions of variable height, a maximum storage capacity for said container being determined by a fully extended position of said pivotally mounted support legs where said single linear members are in a vertical orientation; and means for controllably moving said pivotally mounted support legs along said tracks for controllably varying the spacing between said upper and lower platforms to achieve said optimum desired storage capacity for said container when said container is to be fully loaded and to collapse said container when said container is in said empty state.

2. A collapsible freight and storage container in accordance with claim 1 wherein said container further comprises a plurality of collapsible accordion side walls mounted to said upper and lower platforms and being movable with said upper platform for fully enclosing the interior of said container in said plurality of different positions.

3. A collapsible freight and storage container in accordance with claim 2 wherein said pivotally mounted support legs are movable in a pendulum motion.

4. A collapsible freight and storage container in accordance with claim 3 wherein said collapsible sidewalls are removably mounted to said platforms.

5. A collapsible freight and storage container in accordance with claim 4 wherein said means for controllably moving said pivotally mounted support legs along said tracks comprises means for locking said support legs in said tracks when said container is at said desired variable height.

6. A collapsible freight and storage container in accordance with claim 1 wherein said pivotally mounted support legs are movable in a pendulum motion.

7. A collapsible freight and storage container in accordance with claim 2 wherein said collapsible sidewalls are removably mounted to said platforms.

8. A collapsible freight and storage container in accordance with claim 1 wherein said means for controllably moving said pivotally mounted support legs along said tracks comprises means for locking said support legs in said tracks when said container is at said desired variable height.

9. A collapsible freight and storage container in accordance with claim 8 wherein said pivotally mounted support legs are movable in a pendulum motion.

10. A collapsible freight and storage container in accordance with claim 1 wherein said plurality of support legs comprise eight of said support legs.

11. A collapsible freight and storage container in accordance with claim 1 wherein said means for controllably moving said pivotally mounted support legs along said tracks comprises gear driving means.

12. A collapsible freight and storage container in accordance with claim 5 wherein said means for controllably moving said pivotally, mounted support legs along said tracks comprises gear driving means.

* * * * *